US008499828B2

(12) United States Patent
Chen

(10) Patent No.: US 8,499,828 B2
(45) Date of Patent: Aug. 6, 2013

(54) MONITORING FLUID MOVEMENT IN A FORMATION

(75) Inventor: Kuo-Chiang Chen, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 558 days.

(21) Appl. No.: 12/639,149

(22) Filed: Dec. 16, 2009

(65) Prior Publication Data

US 2011/0139443 A1 Jun. 16, 2011

(51) Int. Cl.
*E21B 47/00* (2012.01)
*E21B 43/00* (2006.01)

(52) U.S. Cl.
USPC ..... 166/250.01; 166/66

(58) Field of Classification Search
USPC ..... 166/250.01, 66, 248; 702/11, 12; 324/323–325, 332–341, 354–355
See application file for complete search history.

(56) References Cited

U.S. PATENT DOCUMENTS

| | | | | |
|---|---|---|---|---|
| 3,488,574 | A | 1/1970 | Tanguy | |
| 4,570,123 | A | 2/1986 | Grosso | |
| 5,187,440 | A | 2/1993 | Vail | |
| 5,339,037 | A | 8/1994 | Bonner | |
| 5,510,712 | A | 4/1996 | Sezginer | |
| 5,563,514 | A | 10/1996 | Moulin | |
| 5,803,167 | A * | 9/1998 | Bussear et al. | 166/65.1 |
| 6,148,263 | A | 11/2000 | Brooks | |
| 6,351,129 | B1 | 2/2002 | Gounot | |
| 6,415,864 | B1 * | 7/2002 | Ramakrishnan et al. | 166/250.03 |
| 6,541,975 | B2 * | 4/2003 | Strack | 324/323 |
| 6,545,477 | B1 | 4/2003 | Beguin | |
| 6,667,621 | B1 | 12/2003 | Benimeli | |
| 6,670,813 | B2 * | 12/2003 | Strack | 324/323 |
| 6,765,387 | B2 * | 7/2004 | Prammer | 324/368 |
| 6,894,500 | B2 | 5/2005 | Benimeli | |
| 6,919,724 | B2 | 7/2005 | Cheung | |
| 7,000,697 | B2 | 2/2006 | Goode | |
| 7,059,428 | B2 | 6/2006 | Frey | |
| 7,064,551 | B2 | 6/2006 | Dubourg | |
| 7,073,594 | B2 * | 7/2006 | Stegemeier et al. | 166/369 |
| 7,129,704 | B2 | 10/2006 | Delhomme | |
| 7,260,478 | B2 | 8/2007 | Dubourg | |
| 7,272,503 | B2 * | 9/2007 | Strack et al. | 702/7 |
| 7,298,147 | B2 | 11/2007 | Benimeli | |
| 7,388,382 | B2 * | 6/2008 | Strack et al. | 324/368 |
| 7,445,042 | B2 | 11/2008 | Freer | |
| 2003/0066652 | A1 * | 4/2003 | Stegemeier et al. | 166/373 |
| 2003/0094282 | A1 * | 5/2003 | Goode et al. | 166/255.2 |
| 2003/0192689 | A1 * | 10/2003 | Moake et al. | 166/250.01 |
| 2004/0163807 | A1 * | 8/2004 | Vercaemer | 166/250.12 |
| 2005/0179437 | A1 | 8/2005 | Hayman | |
| 2006/0054316 | A1 * | 3/2006 | Heaney et al. | 166/250.01 |
| 2006/0175056 | A1 * | 8/2006 | Vercaemer | 166/250.12 |
| 2007/0103161 | A1 * | 5/2007 | San Martin et al. | 324/366 |

(Continued)

FOREIGN PATENT DOCUMENTS

| | | |
|---|---|---|
| WO | 9429754 | 12/1994 |
| WO | 0065380 | 11/2000 |

*Primary Examiner* — Giovanna Wright
*Assistant Examiner* — Michael Wills, III

(57) ABSTRACT

A technique includes wirelessly communicating between a first telemetry unit and a second telemetry unit in a well completion. The communicating causes a leakage current between the first and second telemetry units. The technique includes monitoring the leakage current to detect a change in location of a formation fluid layer.

17 Claims, 4 Drawing Sheets

U.S. PATENT DOCUMENTS

2007/0103162 A1* 5/2007 Morys et al. ..... 324/367
2007/0289740 A1* 12/2007 Thigpen et al. ..... 166/250.01
2008/0041626 A1 2/2008 Clark
2008/0201080 A1* 8/2008 Lovell et al. ..... 702/12
2009/0159276 A1 6/2009 Chouzenoux
2009/0166024 A1* 7/2009 Chen et al. ..... 166/66
2009/0309591 A1* 12/2009 Goodman et al. ..... 324/303
2010/0134112 A1* 6/2010 Zhang et al. ..... 324/339
2011/0114309 A1* 5/2011 Bloemenkamp et al. ..... 166/250.01

* cited by examiner

MONITORING FLUID MOVEMENT IN A FORMATION

BACKGROUND

1. Field of the Invention

The invention generally relates to monitoring fluid movement in a formation.

2. Description of the Related Art

The following descriptions and examples are not admitted to be prior art by virtue of their inclusion in this section.

For purposes of producing a hydrocarbon-based fluid (oil or gas) from a formation, a wellbore typically is drilled into the formation and a well completion is then installed in the wellbore. The well completion generally includes a production tubing string that extends into the wellbore for purposes of communicating the produced well fluid to the surface. The production tubing string may include various downhole tools to control the production of the hydrocarbon-based fluid.

To allow better control over the production, the well may be segmented into isolated production zones so that the production in each zone may be independently controlled. For purposes of establishing isolated production zones, a typical production tubing string may include devices called packers, which form annular seals between the string and the wellbore wall or casing (if the wellbore is cased). The production tubing string may further include valves that control the inflow of well fluid from the various production zones.

A conventional well may also contain a downhole telemetry system for such purposes as remotely monitoring downhole conditions (pressures and temperatures, for example) and controlling the tools of the production tubing string from the surface of the well. The downhole telemetry system may employ wired or wireless communication. Wired communication may involve communicating over, for example, a wireline cable or over an electrical line that is installed in a tubing string. Wireless telemetry may involve numerous different forms of communication, such as fluid pressure communication, acoustic communication, electromagnetic (EM) communication, etc.

Over the lifetime of a well, the composition of the well fluid that is produced in a given production zone may vary. For example, a given production zone may initially produce a relatively high percentage of hydrocarbon-based fluid. However, over the lifetime of the well, an increasing percentage of water may enter the zone, thereby eventually resulting in an undesirable degree of water production. When this occurs, conventionally, the flow through the valve that controls production from the affected zone is appropriately restricted or shut off to reduce the degree of produced water.

SUMMARY

In an embodiment of the invention, a technique includes wirelessly communicating between a first telemetry unit and a second telemetry unit in a well completion. The communicating causes a leakage current between the first and second telemetry units. The technique includes monitoring the leakage current to detect a change in location of a formation fluid layer.

In another embodiment of the invention, a system that is usable with a well includes a string, downhole telemetry units and a circuit. The string communicates well fluid to an earth surface of the well and includes a segment to receive the well fluid. The downhole telemetry units wirelessly communicate with each other, and the wireless communication produces a leakage current that extends into a region in proximity to the segment. The circuit communicates an indication of the leakage current to allow detection of a change in the location of a formation fluid layer.

In yet another embodiment of the invention, a system that is usable with a well includes a string, downhole telemetry units and a circuit. The string communicates well fluid to an earth surface of the well, and the string includes a segment to receive the well fluid. The downhole telemetry units wirelessly communicate with each other, and the wireless communication produces a first leakage current that extends at a first depth into a region in proximity to the segment, and a second leakage current that extends at a second depth into the region. The circuit communicates indications of the first and second leakage currents to detect a change in the location of a formation fluid layer.

Advantages and other features of the invention will become apparent from the following drawing, description and claims.

BRIEF DESCRIPTION OF THE DRAWING

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of various embodiments of the present invention. However, it will be understood by those skilled in the art that embodiments of the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Techniques and systems are disclosed herein, which take advantage of leakage currents that are generated by downhole wireless telemetry to monitor formation fluid movement. More specifically, leakage currents that are generated by a downhole wireless telemetry extend into the formation and are directly affected by the resistivity of the formation along their path. Thus, for example, a given leakage current in a formation volume that primarily contains oil (a relatively poor conductor) experiences a relatively high resistivity, as compared to the relatively low resistivity that is experienced by a leakage current that passes through a formation volume that contains primarily brine water (a relatively good conductor). Therefore, formation fluid levels and compositions may be tracked by using the leakage currents to monitor the associated resistivities that are experienced by currents. Due to the formation fluid movement tracking that is enabled by the technique, production may be controlled in a manner that inhibits the production of water and encourages the production of a hydrocarbon well fluid.

Figure 1:
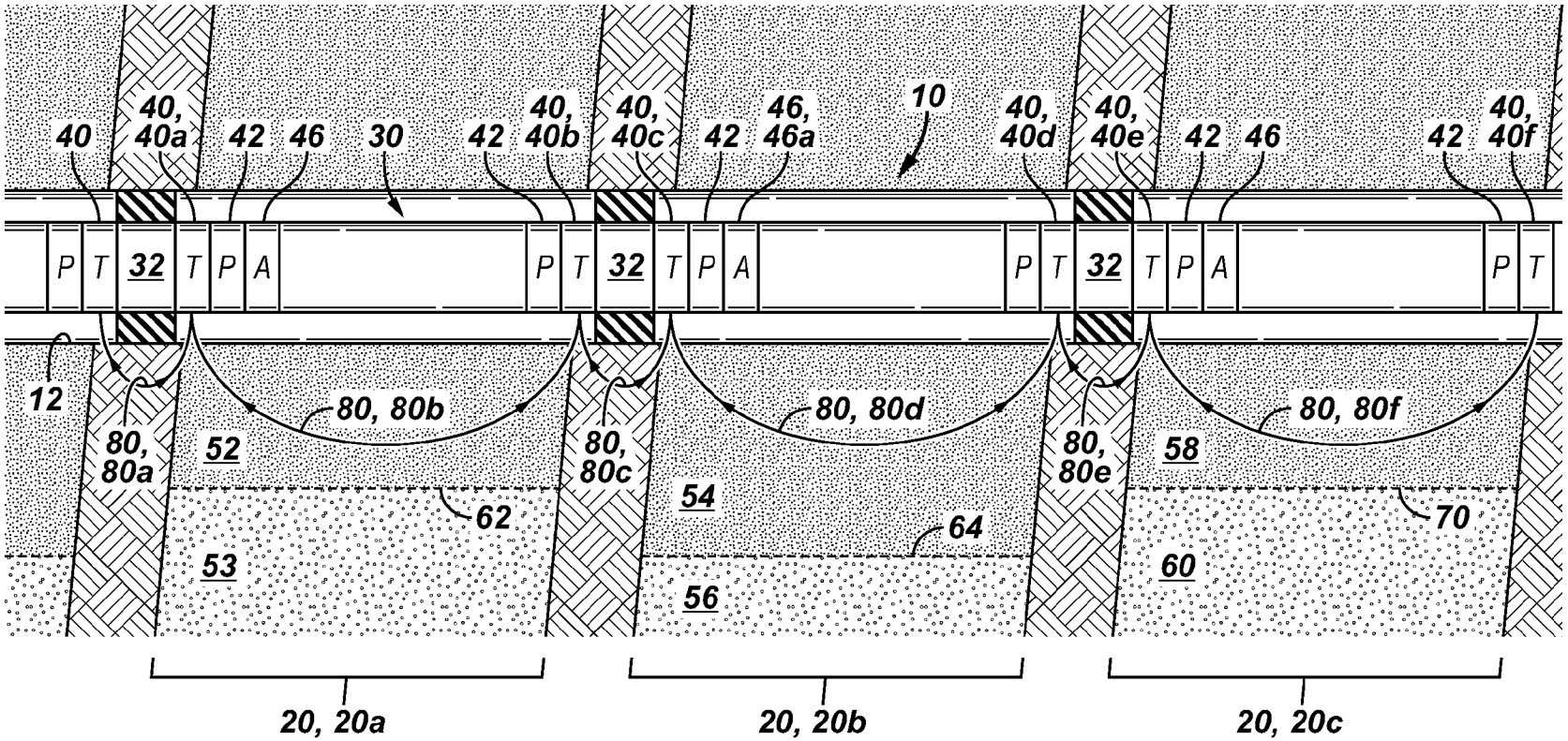
FIGS. 1, 2 and 4 are schematic diagrams of a well illustrating the use of wireless communication-derived leakage currents to detect the movement of formation fluids according to different examples.

Referring to FIG. 1, as a more specific example, a particular well 10 may contain a lateral wellbore 12, which extends through multiple isolated production zones 20 (exemplary production zones 20*a*, 20*b* and 20*c*, being depicted in FIG. 1). The various production zones 20 are created by packers 32 coupled to a production tubing string 30, which extends into the lateral wellbore 12. In this regard, each packer 32 creates an annular barrier between the exterior of the tubing string 30 and the uncased wall of the wellbore 12. Thus, a corresponding production zone 20 is created between adjacent pairs of the packers 32, and, in general, the production zones 20 are relatively hydraulically isolated from each other.

It is noted that although FIG. 1 depicts a horizontal and/or deviated wellbore, the techniques and systems that are described herein may likewise be applied to vertical and generally non-horizontal/deviated wellbores, in accordance with other examples. Furthermore, various modifications and variations may be made to the specific well that is illustrated in FIG. 1 without departing from the spirit and scope of the invention. For example, the wellbore 12 may be cased, in accordance with other examples.

In addition to the packers 32, the production tubing string 30 includes wireless telemetry units 40 (exemplary telemetry units 40*a*, 40*b*, 40*c*, 40*d*, 40*e* and 40*f*, being depicted in FIG. 1), which wirelessly communicate with each other for purposes of communicating information, such as commands, sensor data, requests, etc., along the wellbore 12. For the examples described herein, the telemetry units 40 transmit and receive electromagnetic (EM) waves, which propagate along the production tubing string 30 for purposes of communicating information (e.g., data indicative of sensed downhole conditions, commands, inquiries, etc.) along the wellbore 12.

As a more specific example, in some arrangements, each telemetry unit 40 includes a transmitter and receiver, or is a "transceiver," which permits the telemetry unit 40 to receive wirelessly-communicated data, transmit wireless-communicated data and relay wirelessly-communicated data to an adjacent telemetry unit 40 along the wellbore 12. As a non-limiting example, a particular wireless communication may involve the communication of a command from the surface of the well to a valve actuator 46*a*. The telemetry unit 40*a* receives a wireless communication indicative of this command and transmits a wireless EM wave that propagates along the production tubing string 30 to the telemetry unit 40*b*. The telemetry unit 40*b*, in turn, generates a wireless signal that encodes the command, and this wireless signal propagates to the wireless telemetry unit 40*c*. The wireless telemetry unit 40*c* may then decode the command and control the actuator 46*a* accordingly. Uphole communication may proceed in a similar serial manner in the opposite direction for purposes of communicating command, sensor or other data to the surface of the well, to an uphole component and/or to another telemetry unit 40.

As a non-limiting example, for purposes of communicating a particular wireless signal, the telemetry unit 40 may contain an electrode that serves as a dipole to inject a current that propagates along the production tubing string 30. The receiver of the telemetry unit 40, which receives the wireless communication, may also include an electrode that serves as a dipole for receiving the wireless signal. Although, ideally, all of the injected current propagates along the production tubing string 30, some of the injected current may result in leakage current that extends into the surrounding formation.

More specifically, FIG. 1 depicts leakage current paths 80 (exemplary leakage current paths 80*a*, 80*b*, 80*c*, 80*d*, 80*e* and 80*f*, being depicted in FIG. 1), which extend between adjacent telemetry units 40. More specifically, each of the leakage current paths 80 extends into the surrounding formation at a depth that establishes a corresponding depth of investigation. By monitoring the magnitude of a given leakage current, an assessment may be made regarding the corresponding fluid composition in an associated region of the formation. For example, for the production zone 20*a*, a primarily hydrocarbon bearing volume 52 immediately surrounds the wellbore 12. Because the corresponding leakage current path 80*b* extends through the volume 52, the corresponding leakage current experiences a relatively high resistivity and as a result, has a relatively low magnitude. For the state of the well that is depicted in the drawing, the leakage paths 80*d* and 80*f*, which are associated with production zones 20*b* and 20*c*, also extend through hydrocarbon bearing volumes 54 and 58, respectively; and as a result, the corresponding leakage currents also indicate the presence of the hydrocarbon fluid immediately surrounding the wellbore 12 in these zones. As shown in FIG. 1, water bearing volumes 53, 56 and 60 may be located at distances that are outside of the range of their respective leakage current paths 80*b*, 80*d* and 80*f*.

The fluid layers in the formation typically move over the lifetime of the well 10 due to production. Therefore, hydrocarbon-water boundaries 62, 64 and 70 may change as a result of producing the well 10. These changes, in turn, may eventually result in water being produced in one or more of the production zones 20. When the water level approaches the associated depth of investigation of one of the leakage current paths, the magnitude of the corresponding leakage current should reflect the change in composition in the associated formation volume.

Figure 2:
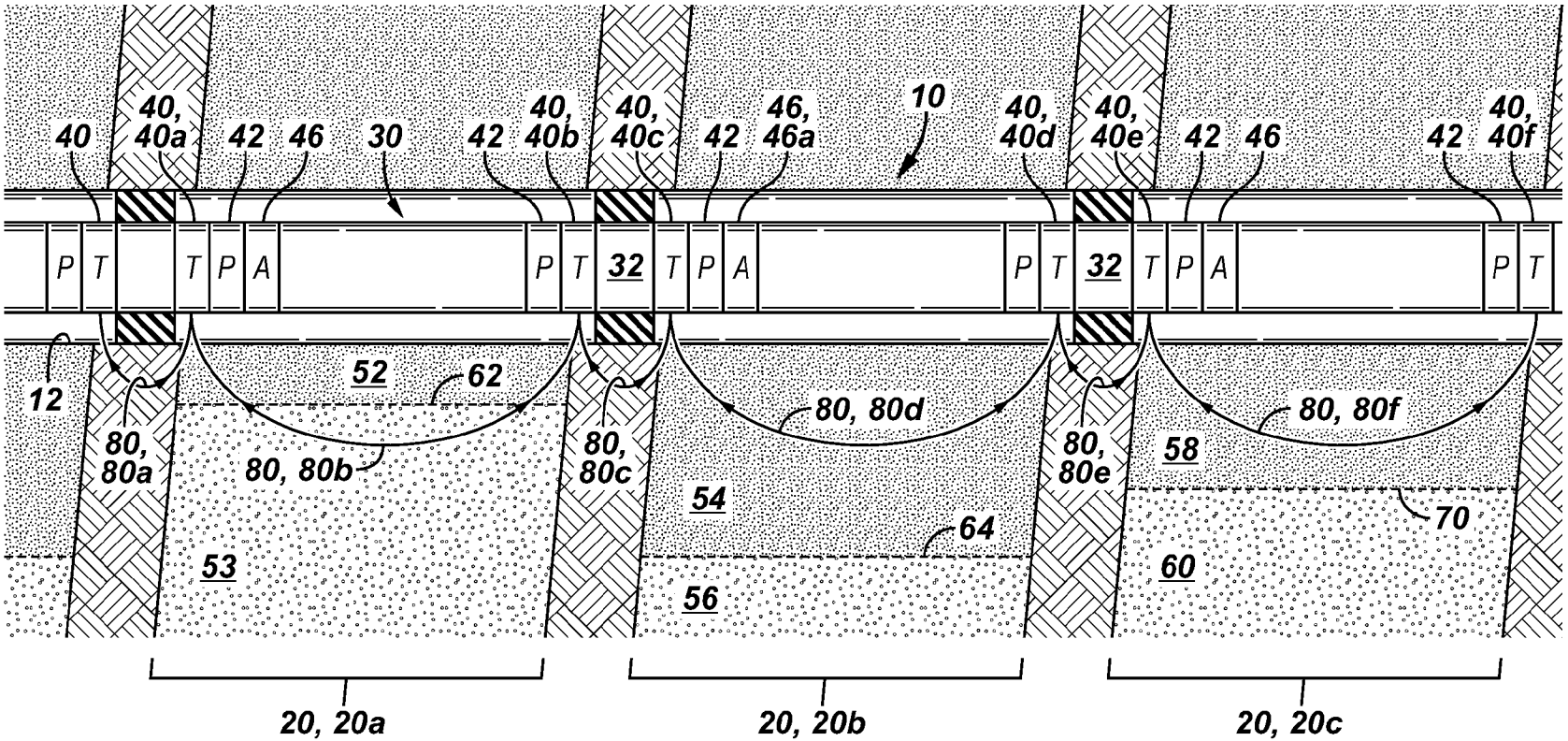

As an example, FIG. 2 depicts a state of the well 10 at a different point in time. For this state of the well, the hydrocarbon-water fluid boundary 62 has moved closer to the wellbore 12, and as a result, the leakage current path 80*b* extends into the water bearing volume 53. For this example, because brine water has a significantly lower resistivity as compared to oil, for example, the corresponding leakage current should experience a significantly lower resistivity. As a result, the magnitude of the observed leakage current increases, which indicates proximity of the hydrocarbon-water interface 62 to the wellbore 12.

Accordingly, an operator at the surface of the well may perform corrective action in response to observing the fluid composition change in the production zone 20*a* (for this example) prior to water being produced into the production tubing string 30 from the production zone 20*a*. This corrective action may include, for example, remotely actuating a corresponding actuator 46 of the zone 20*a* for the purposes of restricting or shutting off production from the zone 20*a*. Of course, other corrective actions may also be employed, in accordance with other examples.

The above-described monitoring of the leakage currents may be performed using a variety of different systems and techniques, in accordance with the particular implementation. As one example, the telemetry units 40 may measure the leakage current of their associated production zones 20 and communicate indications of the measured leakage currents to corresponding circuitry at the surface of the well. In this manner, these communications may occur periodically or upon request from the circuitry at the surface of the well, as just a few non-limiting examples. The leakage current may be measured, as a non-limiting example, by a comparison of the current received by a particular telemetry unit 40 with the current that is injected by the corresponding transmitting telemetry unit 40.

In other arrangements, the production from the zones 20 may be autonomously controlled downhole. For example, in some arrangements, the well 10 may include one or more controllers downhole to receive indications of the leakage currents from the telemetry units 40, determine resistivities from these indications, detect any fluid level movement based on the determined resistivities, determine whether the production flow from any of the zones needs to be adjusted, and control the actuators 46 accordingly to take a corrective action. Other variations are contemplated and are within the scope of the appended claims.

Among the other features of the production tubing string 30, the string 30 may include a power source 42 for each telemetry unit 40 and possibly each actuator 46. As examples, the power source 42 may be a stored energy source, such as a battery, or a fuel cell. As another example, the power source 42 may be based at least in part on downhole power generation, such as a piezoelectric generator, as a non-limiting example. The production tubing string 30 may include additional, fewer, and/or different components, as can be appreciated by the skilled artisan, in accordance with other examples.

Figure 3:
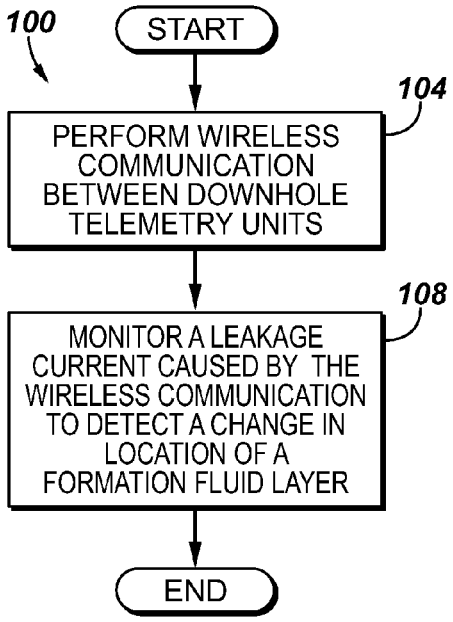
FIGS. 3 and 5 are flow diagrams depicting techniques to use wireless communication-derived leakage currents to detect formation fluid movements according to different examples.

Referring to FIG. 3, a technique 100 may be implemented for purposes of monitoring formation fluid movement. Pursuant to the technique 100, wireless communication is performed (block 104) between downhole telemetry units in a well. This communication causes a leakage current that is monitored (block 108) to detect a change in the location of a formation fluid boundary layer.

Other variations are contemplated and are within the scope of the appended claims. For example, in the implementation described above, one leakage path and thus, one associated depth of investigation, was used per production zone 20. However, referring to FIG. 4, in another implementation, multiple leakage paths may be established per production zone 20 for purposes of creating multiple depths of investigation. For the particular example shown in the drawing, an additional leakage current path 88 (exemplary leakage current paths 88*a*, 88*b* and 88*c*, being depicted in FIG. 4) is created in each production zone 20. These additional leakage current paths 88 have associated depths of investigation that extend at a different depth than previously investigated, such as farther out from the wellbore 12.

Thus, using the production zone 20*a* as an example, the leakage current path 88*a* has an associated deeper depth of investigation than the depth of investigation of the leakage current path 80*b*. Through the use of two or more leakage current paths per zone 20, an operator at the surface of the well or alternatively, an autonomous controller downhole, is presented with a more precise picture regarding formation fluid movement. For example, for the production zone 20*c*, the leakage current path 80*f* does not detect the hydrocarbon-water boundary 70 or, in general, the presence of the water bearing volume 60. However, the water bearing volume 60 may be detected using the leakage current path 88*c*. As another example, for the production zone 20*a*, the farther extending leakage current path 88*a* may provide an indication of the extent of the water bearing formation volume 53. As another example, in the production zone 20*b* the deeper leakage current path 88*b* provides an indication of the extent of the hydrocarbon bearing volume 54; and as shown in FIG. 4, does not yet extend into the water bearing formation volume 56 that is located still further away from the wellbore 12.

As one example, the wider ranging leakage current paths 88 may be created using telemetry units from other surrounding production zones 20. For example, for the production zone 20*b*, a telemetry unit 40*b* from the adjacent production zone 20*a* and a telemetry unit 40*e* from the adjacent production zone 20*c* are used to create the leakage current path 88*b*.

Figure 4:
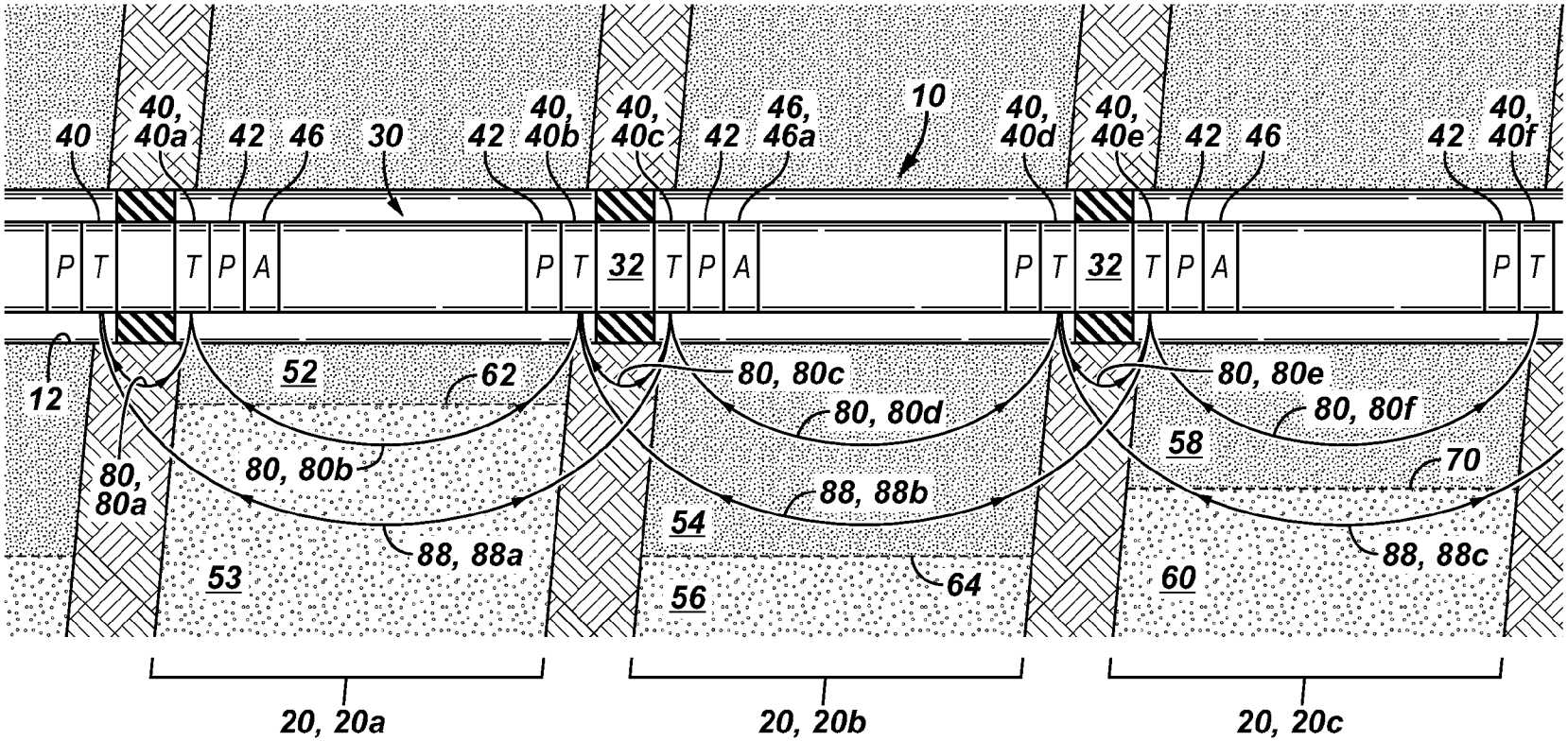

It is noted that FIGS. 1, 2 and 4 present just a few examples of downhole wireless telemetry systems that may be used for purposes of using leakage currents to monitor formation fluid movement. Other variations are contemplated and are within the scope of the appended claims. For example, in accordance with other implementations, more than two leakage current paths may be established in any particular zone for the purpose of creating more than two associated depths of investigation and therefore present an even higher resolution "picture" of the surrounding formation fluids. As yet another example, a different well may vary the depths of investigation per production zone. In other words, the number of leakage paths and associated depths of investigation may vary among the production zones.

Figure 5:
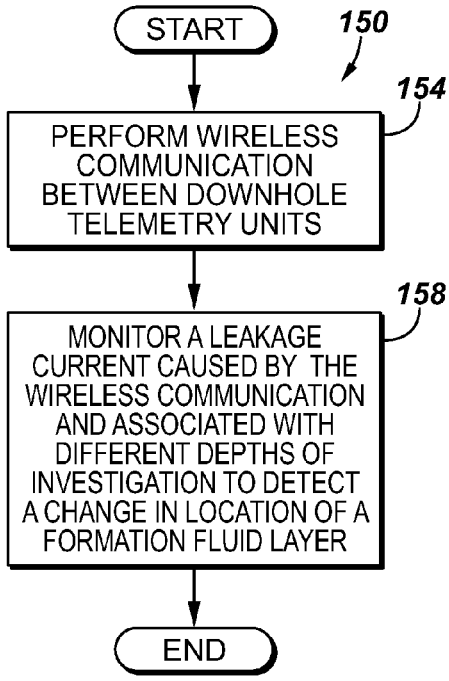

Referring to FIG. 5, generally, a technique 150 includes performing wireless communication between downhole telemetry units, pursuant to block 154. Leakage currents, which may be associated with different depths of investigation and are caused by the wireless communication, are monitored, pursuant to block 158, to detect a change in location of a formation fluid layer.

Figure 6:
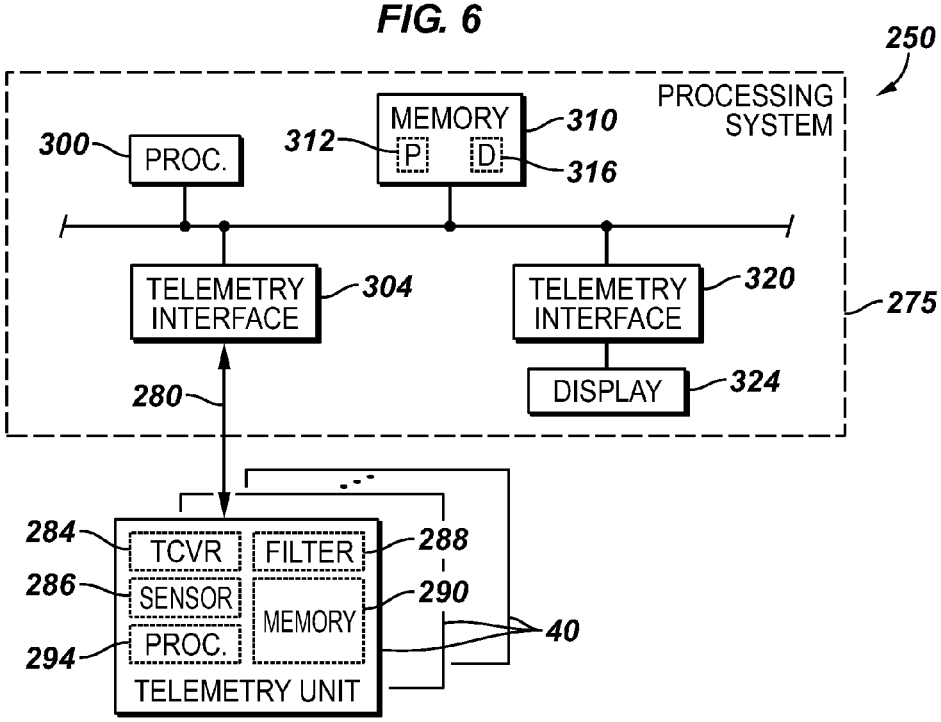
FIG. 6 is a schematic diagram of a system to monitor formation fluid movement using wireless communication-derived leakage currents according to an example.

The above-described systems and techniques may take on numerous forms, depending on the implementation. As a specific non-limiting example, FIG. 6 depicts an exemplary architecture 250 for an illustrative system. As depicted in the drawing, the telemetry unit 40 may be, as a non-limiting example, a processor-based system, which includes a processor 294 and memory 290. It is noted that the processor 294 may, as an example, be one or more microprocessors or microcontrollers. Accordingly the processor 294 may, for example, execute instructions that are stored in the memory 290 for purposes of measuring leakage current, communicating with other telemetry units 40, decoding data, submitting requests over telemetry channels, decoding commands, transmitting indications of measured leakage current magnitudes to the surface or to a downhole controller, among other purposes.

As shown in FIG. 6, the telemetry unit 40 may include a sensor 286 for purposes of measuring the leakage current as well as a filter 288 for purposes of discriminating between various leakage currents. In this regard, the filter 288, which may be implemented in hardware or software, may discriminate currents among the leakage current paths based on a time signature, current signature, frequency, etc., of the particular wireless communication path. As a non-limiting example, referring to FIG. 1, communications between the telemetry units 40*a* and 40*b* may contain a particular signature unique to the path shown between the two telemetry units, which distinguish this path from the communication paths between the other telemetry units 40.

The telemetry unit 294 may also include a transceiver 284. The transceiver 284 may contain a transmitter and a receiver for purposes of wirelessly transmitting and receiving, respectively, with other telemetry units.

In general, the telemetry units 40 communicate with a processing system 275. Depending on the particular implementation, the processing system 275 may be, as examples, an autonomous downhole controller or may be a processing system that is located at the surface of the well. Typically, the telemetry units 40 communicate with the processing system 275 over a communication link 280. Depending on the particular implementation, the communication link 280 may be a wired link or a wireless (a pressure pulse link, an acoustic link, an EM link, etc.) link. In this regard, in accordance with some implementations, the uppermost telemetry unit 40 may communicate with a telemetry unit 304 of the processing system 275 via the link 280. In other implementations, the telemetry unit 40 may communicate with another wired or wireless telemetry unit for purposes of establishing uphole or intrawell communication. As a result, many variations are contemplated and are within the scope of the appended claims.

In general, the processing system 275 may receive indications of the leakage currents and monitor these indications for purposes of determining formation fluid boundary movement. In some implementations, the processing system 275 may take corrected action in response to the monitored formation fluid movement. In this regard, the processing system 275 may use the telemetry interface 304 to not only monitor the formation fluid movement, but also control downhole components (such as valves, for example) for purposes of responding to these changes. As a non-limiting example, the processing system 275 may include a processor 300 (such as one or more microcontrollers and/or microprocessors, as non-limiting examples) that is coupled to the telemetry interface 304, as well as a memory 310. In general, the memory 310 may store program instructions 312, which when executed by the processor 300 cause the processor 300 to perform the above-described functions of the processing system 275. The memory 310 may also store various input and output datasets 316 involved in these functions, such as, for example, datasets indicative of historical leakage current magnitudes, observed and historic resistivities, current valve settings, time, etc., depending on the particular implementation.

As also depicted in FIG. 6, for implementations in which the processing system 275 is located at the surface of the well, the processing system 275 may include a display interface 320 and display 324 for purposes of permitting an operator to observe the monitored formation fluid compositions and fluid movements.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

wirelessly communicating between a first telemetry unit and a second telemetry unit in a well completion located in a wellbore, the communicating causing a leakage current which extends out into a fluid bearing volume surrounding the wellbore between the first and second telemetry units;

monitoring the leakage current to detect a change in location of a formation fluid layer in the fluid bearing volume surrounding the wellbore; and regulating a well fluid flow into the well completion in response to the monitoring.

2. The method of claim 1, wherein the act of monitoring the leakage current comprise monitoring for a change in the leakage current indicative of the change in location of the formation fluid.

3. The method of claim 1, wherein the first and second telemetry units are disposed in an isolated zone of the well completion.

4. The method of claim 1, wherein the first and second telemetry units are disposed in different isolated zones of the well completion.

5. The method of claim 1, wherein the act of wirelessly communicating comprises communicating data indicative of a command to actuate an actuator of the well completion or communicating data indicative of a status of a component of the well.

6. The method of claim 1, wherein the act of monitoring comprises monitoring the leakage current to detect movement of a water layer.

7. The method of claim 1, wherein the leakage current is associated with a first depth of investigation in an isolated zone, the method further comprising generating another leakage current in the zone, said another leakage current being associated with a depth of investigation different from the first depth of investigation.

8. The method of claim 7, wherein the act of generating said another leakage current comprises wirelessly communicating.

9. The method of claim 7, wherein the act of generating said another leakage current comprises wirelessly communicating between a third telemetry unit and a fourth telemetry unit, the first and second telemetry units are located in a first isolated zone, the third telemetry unit is located in a second isolated zone, and the fourth telemetry unit is located in a third isolated zone.

10. A system usable with a well, comprising:

a string to communicate well fluid to an earth surface of the well, the string comprising a segment to receive the well fluid;

downhole telemetry units to wirelessly communicate with each other, the wireless communication producing a leakage current that extends in a region in proximity to the segment and surrounding the well; and a circuit to monitor the leakage current to detect a change in location of a formation fluid layer external to the well, wherein the circuit is adapted to monitor the leakage current for a change indicative of the change in location of the formation fluid.

11. The system of claim 10, wherein the circuit is disposed at the earth surface or downhole in the well.

12. The system of claim 10, wherein the downhole telemetry units comprise first and second telemetry units, the leakage current is between the first and second telemetry units, and the first and second telemetry units are disposed in an isolated zone of the well.

13. The system of claim 10, wherein the downhole telemetry units comprise first and second telemetry units, the leakage current is between the first and second telemetry units, and the first and second telemetry units are disposed in different isolated zones of the well.

14. The system of claim 10, wherein the telemetry units are adapted to wirelessly communicate data indicative of a command to actuate an actuator of the well completion or wirelessly communicate data indicative of a status of a component of the well.

15. A system usable with a well, comprising:

a string to communicate well fluid to an earth surface of the well, the string comprising a segment to receive the well fluid;

downhole telemetry units to wirelessly communicate with each other, the wireless communication producing a first leakage current that extends at a first depth into a region in proximity to the segment and a second leakage current that extends at a second depth into the region; and a circuit to monitor the first and second leakage currents to detect a change in location of a formation fluid layer, wherein the circuit is adapted to monitor the leakage current to detect movement of a water layer.

16. The system of claim 15, wherein the downhole telemetry units comprise:

a first telemetry unit;

a second telemetry unit to wirelessly communicate with the first telemetry unit to produce the first leakage current;

a third telemetry unit; and a fourth telemetry unit to wirelessly communicate with the third telemetry unit to produce the first leakage current.

17. The system of claim 16, wherein the first and second telemetry units are located in a first isolated zone, the third telemetry unit is located in a second isolated zone, and the fourth telemetry unit is located in a third isolated zone.

* * * * *